US006426732B1

(12) United States Patent
Makino

(10) Patent No.: US 6,426,732 B1
(45) Date of Patent: Jul. 30, 2002

(54) METHOD OF ENERGIZING PLASMA DISPLAY PANEL

(75) Inventor: Mitsuyoshi Makino, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/083,118

(22) Filed: May 22, 1998

(30) Foreign Application Priority Data

May 30, 1997 (JP) ..... 9-141697
Aug. 21, 1997 (JP) ..... 9-224948

(51) Int. Cl.[7] ..... G09G 3/28
(52) U.S. Cl. ..... 345/68; 315/169.4
(58) Field of Search ..... 345/204, 60–68, 345/208, 210, 211; 315/169.4, 169.1, 169.2

(56) References Cited

U.S. PATENT DOCUMENTS 4,132,924 A * 1/1979 Yamaguchi et al. ..... 340/779
4,320,418 A * 3/1982 Pavliscak ..... 358/240
5,583,527 A * 12/1996 Fujisaki et al. ..... 345/55
5,627,569 A * 5/1997 Matsuzaki et al. ..... 345/214
5,742,265 A * 4/1998 Stoller et al. ..... 345/60
5,745,085 A * 4/1998 Tomio et al. ..... 345/63
5,790,087 A * 8/1998 Shigeta et al. ..... 345/67
6,002,381 A * 12/1999 Tomio et al. ..... 345/60
6,011,355 A * 1/2000 Nagai ..... 315/167.3
6,023,258 A * 2/2000 Kuriyama et al. ..... 345/60

FOREIGN PATENT DOCUMENTS

| | | |
|---|---|---|
| JP | 50-39024 | 4/1975 |
| JP | 52-150941 | 12/1977 |
| JP | 54-148435 | 11/1979 |
| JP | 56-142593 | 11/1981 |
| JP | 59-61886 | 4/1984 |
| JP | 62-196696 | 8/1987 |
| JP | 03-175491 | 7/1991 |
| JP | 56-104389 | 8/1991 |
| JP | 3-259183 | 11/1991 |
| JP | 04-267293 | 9/1992 |
| JP | 5-6147 | 1/1993 |
| JP | 06-67617 | 3/1994 |
| JP | 06-187915 | 7/1994 |
| JP | 06348227 | 12/1994 |
| JP | 8-124485 | 5/1996 |
| JP | 9-68944 | 3/1997 |
| JP | 10-143107 | 5/1998 |
| JP | 11-85099 | 3/1999 |

* cited by examiner

*Primary Examiner*—Bipin Shalwala
*Assistant Examiner*—Vanel Frenel
(74) *Attorney, Agent, or Firm*—Sughrue Mion, PLLC

(57) ABSTRACT

A discharge sustaining pulse voltage comprising a preceding high voltage $V_1$ of a short duration $t_1$ and a subsequent low voltage $V_2$ of a long duration $t_2$ is applied to common and scanning electrodes of a plasma display panel.

15 Claims, 16 Drawing Sheets

METHOD OF ENERGIZING PLASMA DISPLAY PANEL

BACKGROUND OF THE INVENTION

1. Field of the Invention

The present invention relates to a method of energizing an AC discharge plasma display panel for use as a large-area flat display panel with a personal computer, a workstation, or a wall television set.

2. Description of the Relates Art

Plasma display panels (also referred to as "PDP") are classified according to operating principles into DC discharge PDPs in which electrodes are exposed to a discharge gas and cause a discharge only when a voltage is applied, and AC discharge PDPs in which electrodes are covered with a dielectric layer and cause a discharge while being not exposed to a discharge gas. Discharge cells of the AC discharge PDPs have a memory function because of a charge storage action of the dielectric layer.

One general AC discharge color PDP will be described below with reference to FIG. 1 of the accompanying drawings. FIG. 1 shows a fragmentary cross section of the AC discharge color PDP. As shown in FIG. 1, the AC discharge color PDP comprises a front substrate 10 of glass and a back substrate 11 of glass which are spaced from each other with a space defined therebetween.

Scanning electrodes 12 and common electrodes 13 which are spaced from each other by given distances are disposed on the front substrate 10. The scanning electrodes 12 and the common electrodes 13 are covered with an insulating layer 15*a* which is covered with a protective layer 16 of MgO or the like that protects the insulating layer 15*a* from electric discharges.

Data electrodes 19 which extend perpendicularly to the scanning electrodes 12 and the common electrodes 13 are disposed on the back substrate 11. The data electrodes 19 are covered with an insulating layer 15*b* which is coated with a phosphor layer 18 that converts an ultraviolet radiation generated by electric discharges into visible light for display.

Partitions 17 extend between the insulating layers 15*a* and 15*b*, providing a discharge space 20 therebetween. The partitions 17 define pixels for displaying images on the PDP. The discharge space 20 is filled with a discharge gas which comprises a mixture of He, Ne, Xe, etc.

FIG. 2 of the accompanying drawings shows the layout of the electrodes in the color PDP shown in FIG. 1.

In FIG. 2, the color PDP has m scanning electrodes $S_i$ (i=1, 2, . . . , m) 12 extending as rows, n data electrodes $D_j$ (j=1, 2, . . . , n) 19 extending as columns, the scanning electrodes $S_i$ and the data electrodes $D_j$ intersect with each other at the pixels, and m common electrodes $C_i$ (i=1, 2, . . . , m) 13 extending as rows parallel to the scanning electrodes $S_i$ and paired with the scanning electrodes $S_i$. The phosphor layer 18 has a plurality of areas aligned respectively with the pixels 14 and coated with different colors of R, G, B for enabling the PDP to display color images.

A process of energizing the conventional color PDP shown in FIGS. 1 and 2 will be described below with reference to FIG. 3 of the accompanying drawings. FIG. 3 is a timing chart of drive voltages which are applied to the electrodes of the conventional color PDP.

First, erasing pulses 21 are applied to all the scanning electrodes 12 to turn off all the pixels which have previously emitted visible light.

Then, preliminary discharge pulses 22 are applied to the common electrodes 13 for forcibly discharging all the pixels to emit visible light. Thereafter, preliminary discharge erasing pulses 23 are applied to all the scanning electrodes 12 to turn off a preliminary discharge at all the pixels. The preliminary discharge allows a subsequent writing discharge to be effected with ease.

After the preliminary discharge is turned off, scanning pulses 24 are applied at different times to the scanning electrodes ($S_1$–$S_m$) 12, and data pulses 27 representative of data to be displayed are applied to the data electrodes ($D_1$–$D_n$) 19 in timed relation to the scanning pulses 24. Diagonal lines indicated in the data pulses 27 show that the presence or absence of data pulses 27 is determined according to whether there is data to be displayed or not. If a data pulse 27 is applied to a pixel when a scanning pulse 24 is applied thereto, then a writing discharge occurs at the pixel in the discharge space 20 between the scanning electrode 12 and the data electrode 19. If no data pulse 27 is applied to a pixel when a scanning pulse 24 is applied thereto, then no writing discharge occurs at the pixel.

At a pixel where a writing discharge occurs, a positive charge called a wall charge is collected in the insulating layer 15*a* on the scanning electrodes 12. At this time, a negative wall charge is collected in the dielectric layer 15*b* on the data electrodes 19. The positive wall charge in the insulating layer 15*a* and first negative sustaining pulses 25 applied to the common electrodes 13 are superposed thereby to generate a first sustained discharge. When the first sustained discharge is generated, a positive wall charge is collected in the insulating layer 15*a* on the common electrodes 13, and a negative wall charge is collected in the insulating layer 15*a* on the scanning electrodes 12. Second sustaining pulses 26 applied to the scanning electrodes 12 are superposed on the potential difference between these wall charges thereby to generate a second sustained discharge. In this manner, the potential difference between wall charges developed by an xth sustained discharge and (x+1)th sustaining pulses are superposed thereby to continue sustained discharges. The number of times that a sustained discharge is continued controls the amount of visible light emitted from the pixels.

The voltage of the sustaining pulses 25, 26 is adjusted such that the voltage of these pulses alone will not develop a discharge. At a pixel where no writing discharge has been developed, there is no potential due to a wall charge before the first sustaining pulses 25 are applied. At such a pixel, therefore, no first sustained discharge is produced even when the first sustaining pulses 25 are applied, and no subsequent sustained discharge will be produced.

Each of the erasing pulses 21, the preliminary discharge pulses 22, the preliminary discharge erasing pulses 23, the scanning pulses 24, the sustaining pulses 25, 26, and the data pulses 27 described above has heretofore been a rectangular pulse whose rise and fall times are 1 microsecond or less each as shown in FIG. 4A.

When the color PDP develops a discharge with the rectangular pulse shown in FIG. 4A, a discharging current shown in FIG. 4B flows in an electrode to which the rectangular pulse is applied. The discharging current starts to flow several hundreds nanoseconds after the application of the rectangular pulse, reaches a peak level another several hundreds nanoseconds thereafter, subsequently sustains for several hundreds of nanoseconds, and is then terminated.

The time from the application of the pulse to the start of the discharging current, the time to the peak level, and the subsequent time for which the discharging current is sustained depend on the composition of the discharge gas, the composition of the dielectric layer, the thickness of the dielectric layer, the composition of the electrodes, the sizes of the electrodes, and the size of the discharge space.

For example, a phosphor material has a discharge emission efficiency of about 80 lm/W, and a PDP which is energized by the above conventional process has a much lower discharge emission efficiency of about 1 lm/W. Therefore, the PDP needs to consume a large amount of electric energy in order to increase the emission luminance.

SUMMARY OF THE INVENTION

It is therefore an object of the present invention to provide a method of energizing a plasma display panel to increase emission efficiency with sustained discharges for thereby reducing electric energy consumption.

To achieve the above object, there is provided in accordance with the present invention a method of energizing a plasma display panel having a plurality of scanning electrodes arranged as rows and a plurality of data electrodes arranged as columns, comprising the steps of applying a scanning pulse voltage to the scanning electrodes, applying a data pulse voltage to the data electrodes in synchronism with the scanning pulse voltage for controlling turning-on/off of displayed data, and thereafter, applying a sustaining pulse voltage of a waveform having repetitive units each including a preceding high potential difference of a short duration and a subsequent low potential difference of a long duration, alternately to two electrodes selected from the scanning electrodes, the data electrodes, and common electrodes arranged as rows independently of the scanning electrodes, for thereby keeping a sustaining discharge only in cells where the displayed data is turned on.

The above method allows sustaining pulses to be optimized in waveform for enabling the plasma display panel to display images with increased emission efficiency, increased emission luminance, and reduced electric energy consumption.

The short duration of the preceding high potential difference may be shorter than a delay time from the application of the sustaining pulse voltage until a gas discharging current is maximized.

The short duration of the subsequent low potential difference and a setting of the subsequent low potential difference may be determined to keep the sustaining discharge even in the absence of the duration of the preceding high potential difference.

Each of the repetitive units may include a high voltage pulse of a short duration applied to one of the two electrodes and a low voltage pulse, in opposite polarity to the high voltage pulse, of a long duration applied to the other of the two electrodes after the high voltage pulse has ended.

Each of the repetitive units may include a pulse of a short duration applied to one of the two electrodes and a low voltage pulse, in opposite polarity to the pulse, of a long duration applied to the other of the two electrodes at the same time that the pulse is applied to the one of the two electrodes.

Each of the repetitive units may include a high voltage pulse of a long duration applied to one of the two electrodes and a low voltage pulse, in the same polarity as the high voltage pulse, of a long duration applied to the other of the two electrodes with a delay equal to the short duration of the high voltage pulse, after the application of the high voltage pulse.

A portion of a plurality of sustaining pulses for producing a sustaining discharge may have the waveform of the sustaining pulse voltage.

A plurality of sustaining pulses applied to one of a pair of electrodes for producing a sustaining discharge may have the waveform of the sustaining pulse voltage.

The preceding high potential difference may be generated by an overshoot in excess of the amplitude of the sustaining pulse voltage.

According to the present invention, there is also provided a method of energizing a plasma display panel having a plurality of scanning electrodes arranged as rows and a plurality of data electrodes arranged as columns, comprising the steps of applying a scanning pulse voltage to the scanning electrodes, applying a data pulse voltage to the data electrodes in synchronism with the scanning pulse voltage for controlling turning-on/off of displayed data, and thereafter, applying a sustaining pulse voltage of a waveform having repetitive units each including a preceding low voltage and a subsequent high voltage of a long duration for producing a sustaining discharge, alternately to two electrodes selected from the scanning electrodes, the data electrodes, and common electrodes arranged as rows independently of the scanning electrodes, for thereby keeping a sustaining discharge only in cells where the displayed data is turned on.

The above method also enables the plasma display panel to display images with increased emission efficiency, increased emission luminance, and reduced power consumption.

The preceding low voltage may be of a level and a duration which are selected to fail to produce a sustaining discharge.

The preceding low voltage and the subsequent high voltage may be successively applied.

Each of the repetitive units may include a reference potential or a potential lower than the preceding low voltage, between the preceding low voltage and the subsequent high voltage.

A portion of a plurality of sustaining pulses for producing a sustaining discharge may have the sustaining pulse voltage.

The sustaining pulse voltage may be applied to one of a pair of electrodes for generating a sustaining discharge.

The above and other objects, features, and advantages of the present invention will become apparent from the following description based on the accompanying drawings which illustrate an example of preferred embodiments the present invention.

DESCRIPTION OF THE PREFERRED EMBODIMENTS

Figure 6:
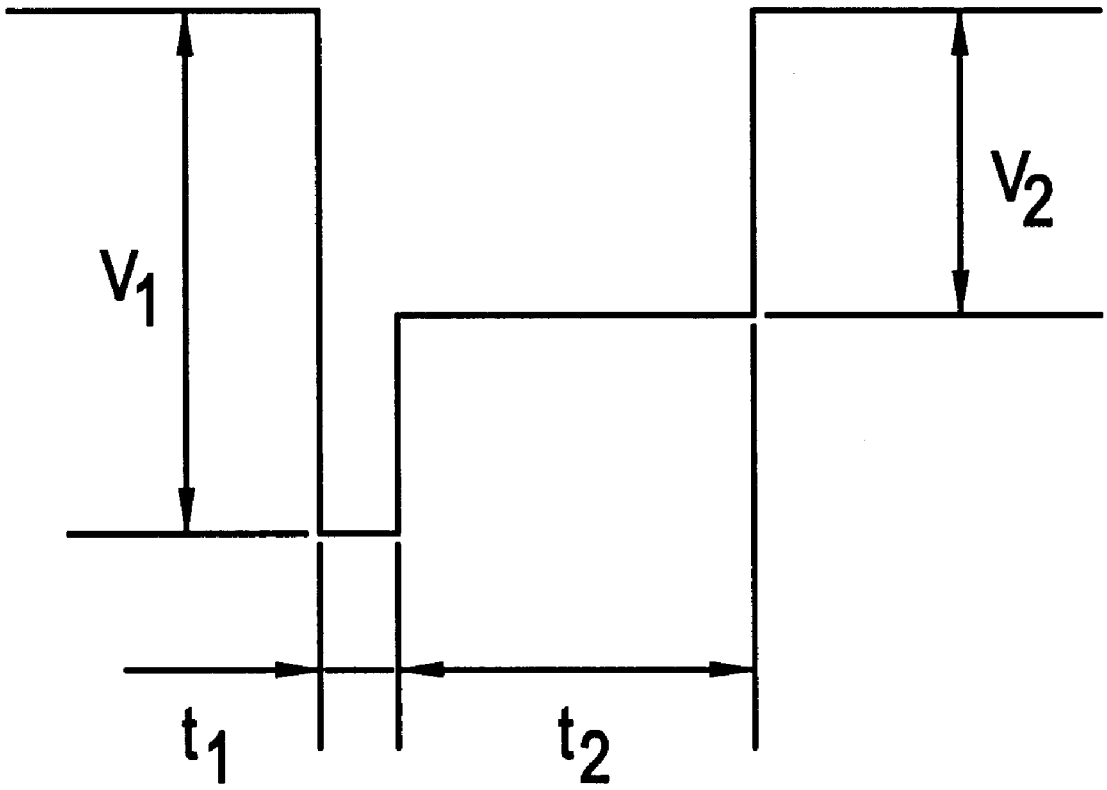
FIG. 6 is a diagram showing the waveform of a pulse employed in a method of energizing a PDP according to a first embodiment of the present invention.

A method of energizing a PDP according to a first embodiment of the present invention will be described below with reference to FIG. 6 which shows the waveform of a pulse employed in the method. The pulse waveform shown in FIG. 6 is produced when a high voltage $V_1$ of 200 V is applied for a short time $t_1$, e.g., of 200 nanoseconds, and thereafter a low voltage $V_2$ of 130 V is applied for a long time $t_2$, e.g., of 4 microseconds. The pulse waveform has such features that the time $t_1$ for which the preceding high voltage $V_1$ is applied is shorter than a time from the application of a pulse until the waveform of a discharging current has a peak value, and the long time $t_2$ and the low voltage $V_2$, following the high voltage $V_1$, are selected to sustain a discharge even without applying the preceding high voltage. The pulse of the above waveform can be used as a sustaining discharge pulse.

Figure 1:
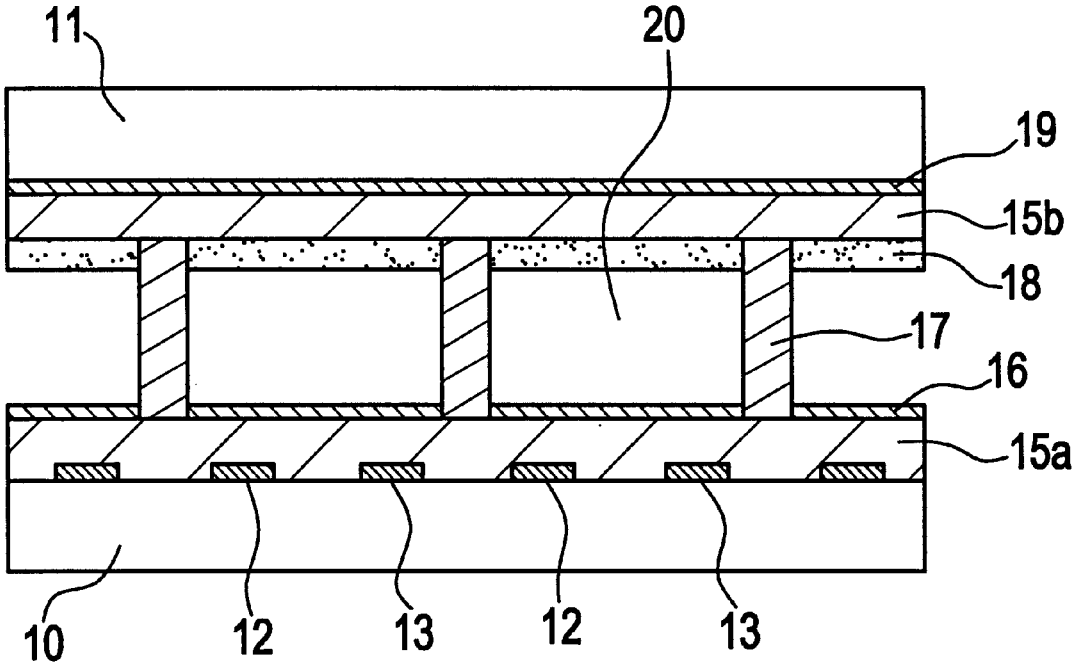
FIG. 1 PRIOR ART
FIG. 1 is a cross-sectional view of a conventional color PDP.
Figure 2:
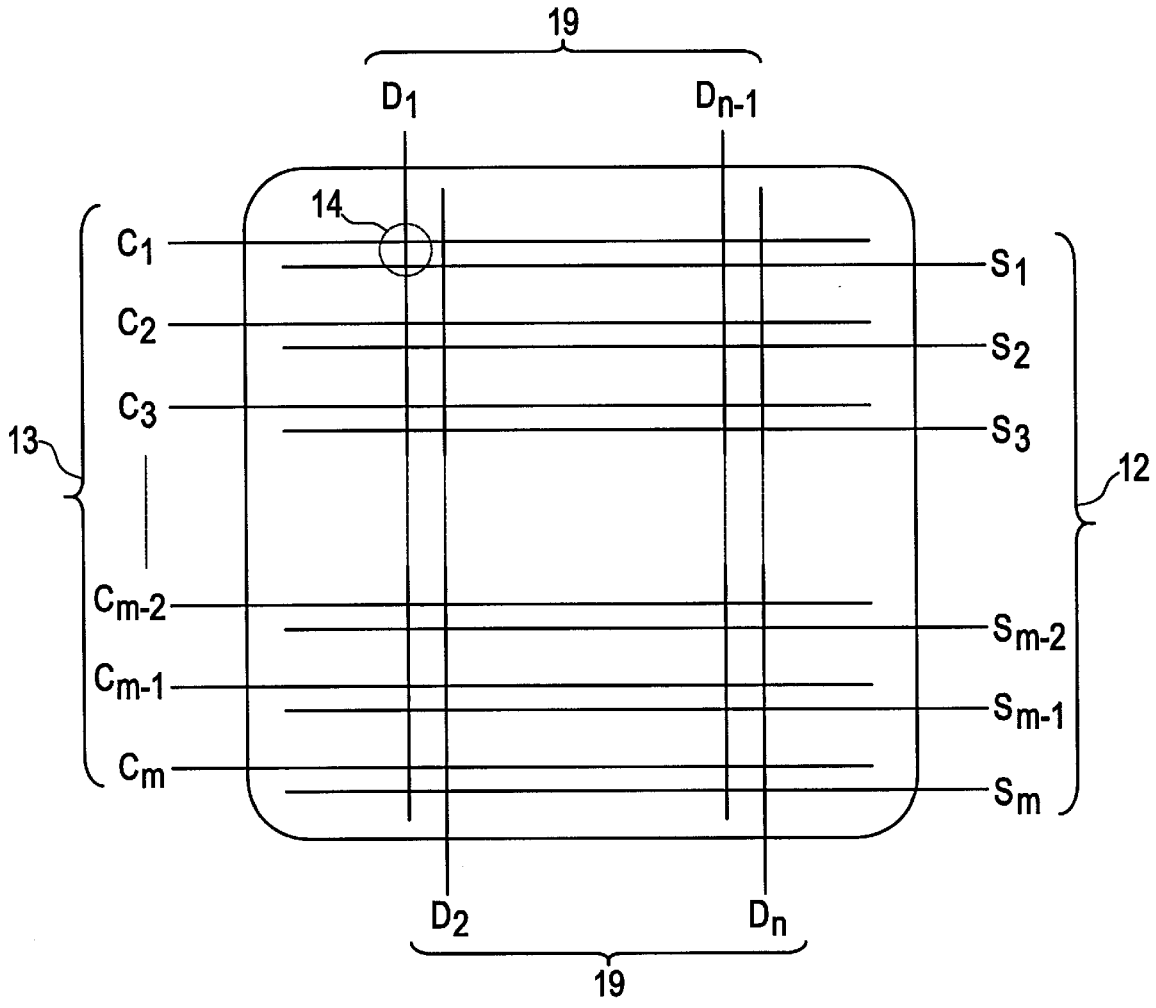
FIG. 2 PRIOR ART
FIG. 2 is a schematic fragmentary plan view showing the layout of electrodes of the conventional color PDP shown in FIG. 1.
Figure 3:
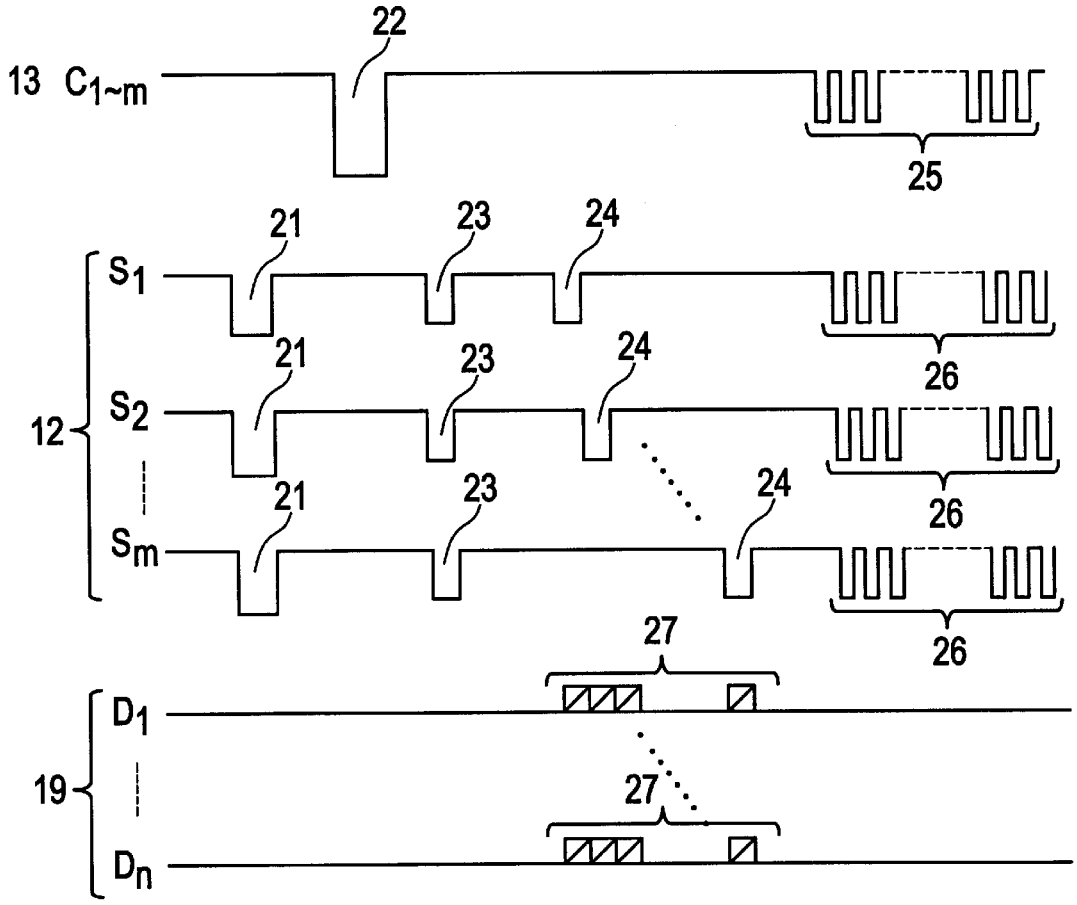
FIG. 3 PRIOR ART
FIG. 3 is a timing chart of drive voltages which are applied to the electrodes of the conventional color PDP.
Figure 4A:
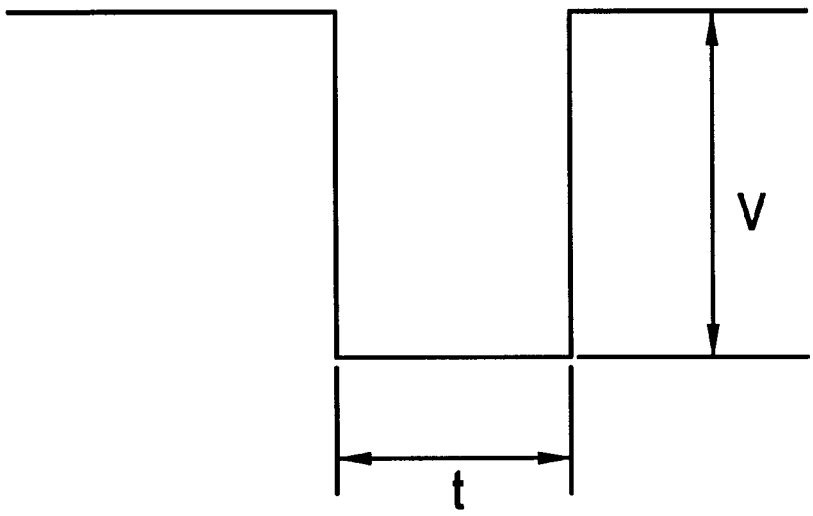
FIG. 4A PRIOR ART
FIG. 4A is a diagram showing the waveform of a pulse employed in a process of energizing the conventional color PDP.
Figure 4B:
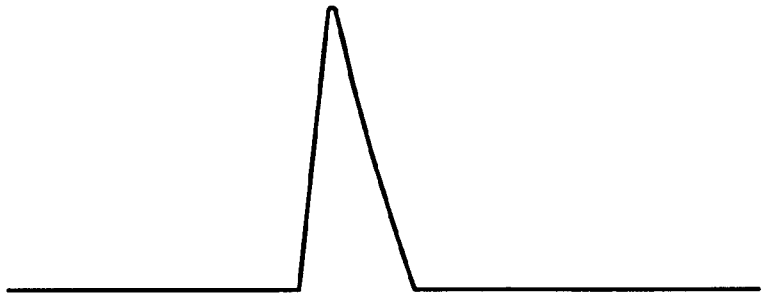
FIG. 4B PRIOR ART
FIG. 4B is a diagram showing the waveform of a discharging current which flows when the pulse shown in FIG. 4A is applied.
Figure 5B:
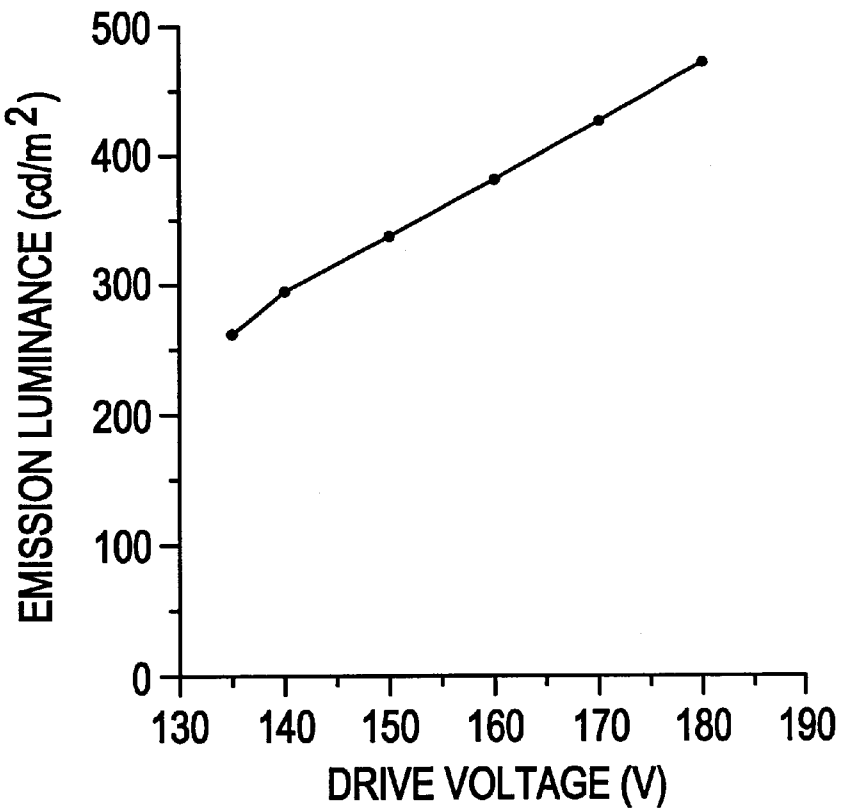
FIG. 5B PRIOR ART
FIG. 5B is a diagram showing the relationship between the drive voltage and the emission luminance with the pulse waveform shown in FIG. 4A.
Figure 5A:
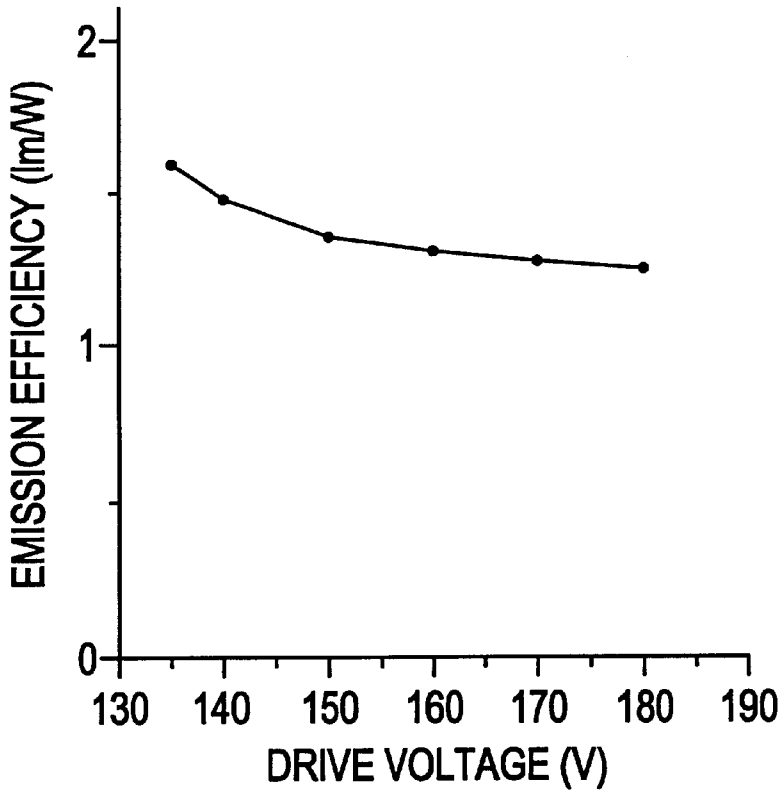
FIG. 5A PRIOR ART
FIG. 5A is a diagram showing the relationship between the drive voltage and the emission efficiency when the pulse shown in FIG. 4A is applied.

A review of FIG. 5A which shows the relationship between the drive voltage and the emission efficiency when the PDP is driven with a conventional rectangular pulse at a frequency of 20 kHz, indicates that the emission efficiency is higher as the drive voltage is lower. However, a review of FIG. 5B which shows the relationship between the drive voltage and the emission luminance when the PDP is driven with a conventional rectangular pulse at a frequency of 20 kHz, indicates that the emission luminance is higher as the drive voltage is higher. Therefore, if the drive voltage is lowered to increase the emission efficiency, then the emission luminance is lowered, and if the drive voltage is increased to increase the emission luminance, then the emission efficiency is lowered.

Figure 7A:
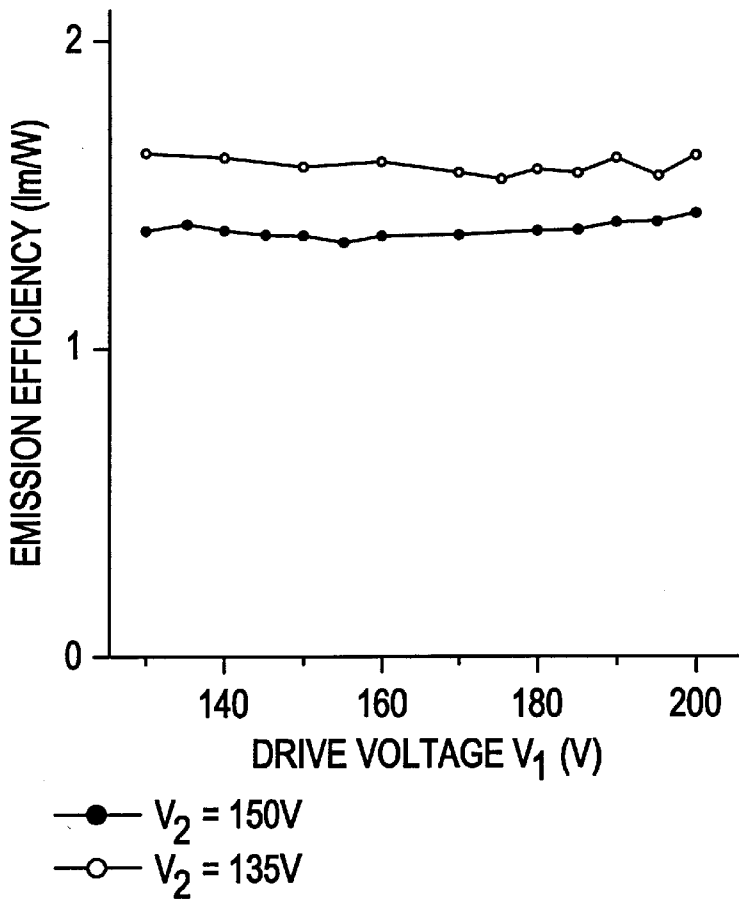
FIG. 7A is a diagram showing the relationship between the pulse voltage and the emission efficiency with the pulse waveform shown in FIG. 6.

FIG. 7A shows the relationship between the voltage $V_1$ of the preceding pulse and the emission efficiency when the PDP is driven with the pulse at a frequency of 20 kHz in the method according to the first embodiment. A study of FIG. 7A indicates that the emission efficiency is higher as the pulse voltage $V_2$ is lower, but has almost no dependency on the preceding pulse voltage $V_1$.

Figure 7B:
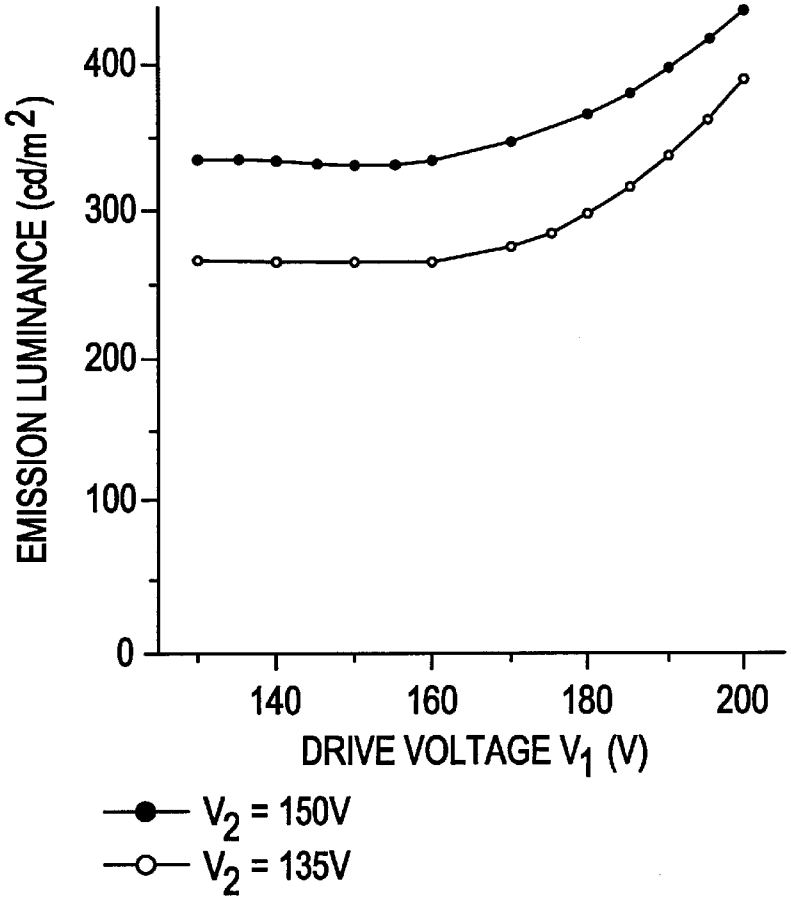
FIG. 7B is a diagram showing the relationship between the pulse voltage and the emission luminance with the pulse waveform shown in FIG. 6.

FIG. 7B shows the relationship between the voltage $V_1$ of the preceding pulse and the emission luminance when the PDP is driven with the pulse at a frequency of 20 kHz in the method according to the first embodiment. A study of FIG. 7B indicates that the emission luminance is higher as the pulse voltage $V_2$ is higher, and the emission luminance also increases as the preceding pulse voltage $V_1$ increases. Therefore, lowering the pulse voltage $V_2$ increases the emission efficiency, and increasing the preceding pulse voltage $V_1$ increases emission luminance. The method according to the first embodiment makes it possible to drive the PDP highly efficiently with high luminance.

Figure 8A:
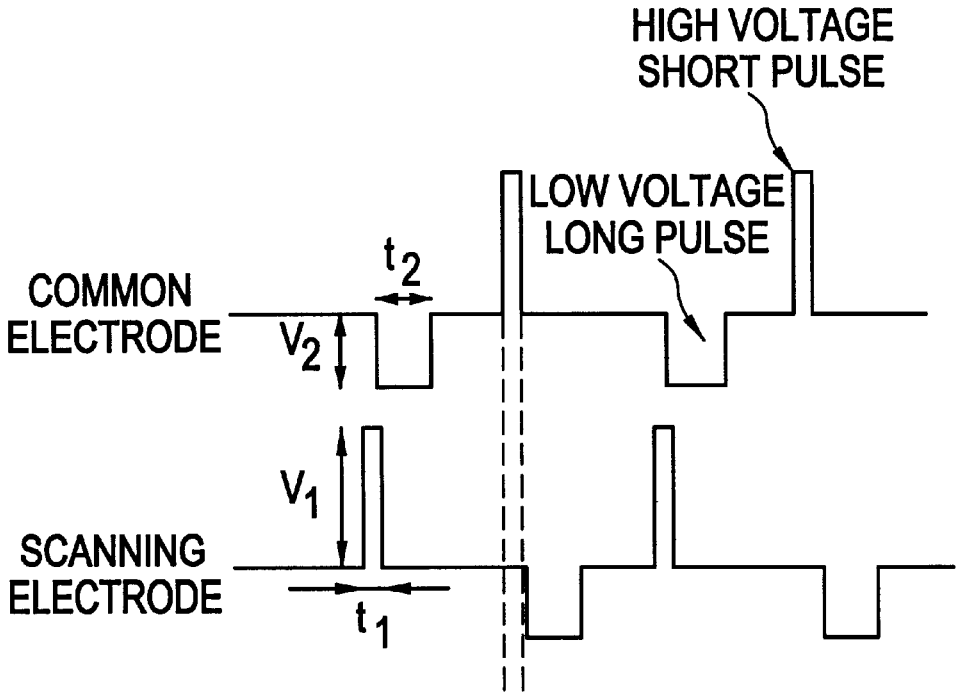
FIG. 8A is a diagram showing the waveforms of voltages applied to common electrodes and scanning electrodes in a method of energizing a PDP according to a second embodiment of the present invention.
Figure 8B:
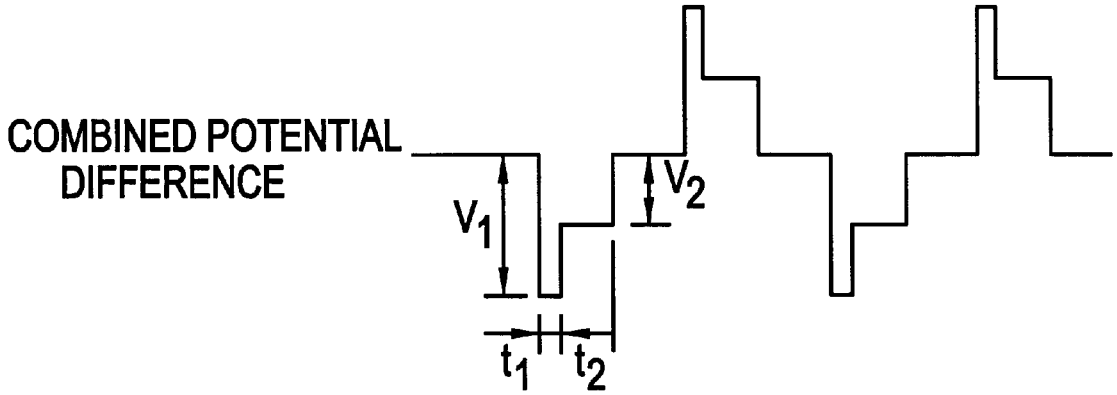
FIG. 8B is a diagram showing the waveform of a potential difference produced when the voltages shown in FIG. 8A are combined with each other.

A method of energizing a PDP according to a second embodiment of the present invention will be described below. FIG. 8A shows the waveforms of voltages applied to common electrodes and scanning electrodes in the method of according to the second embodiment. As shown in FIG. 8A, immediately before a pulse of a low voltage $V_2$ and a long duration $t_2$, which corresponds to a conventional sustaining discharge pulse, is applied to one of the electrodes, a pulse of a high voltage $V_1$ and a short duration $t_1$, which is of opposite polarity to the low voltage $V_2$ pulse, is applied to the other electrode. When these pulses are applied to the electrodes, there is developed a potential difference between the electrodes as shown in FIG. 8B, which has the same waveform as the pulse applied to energize the PDP highly efficiently for high luminance in the method according to the first embodiment.

Figure 9A:
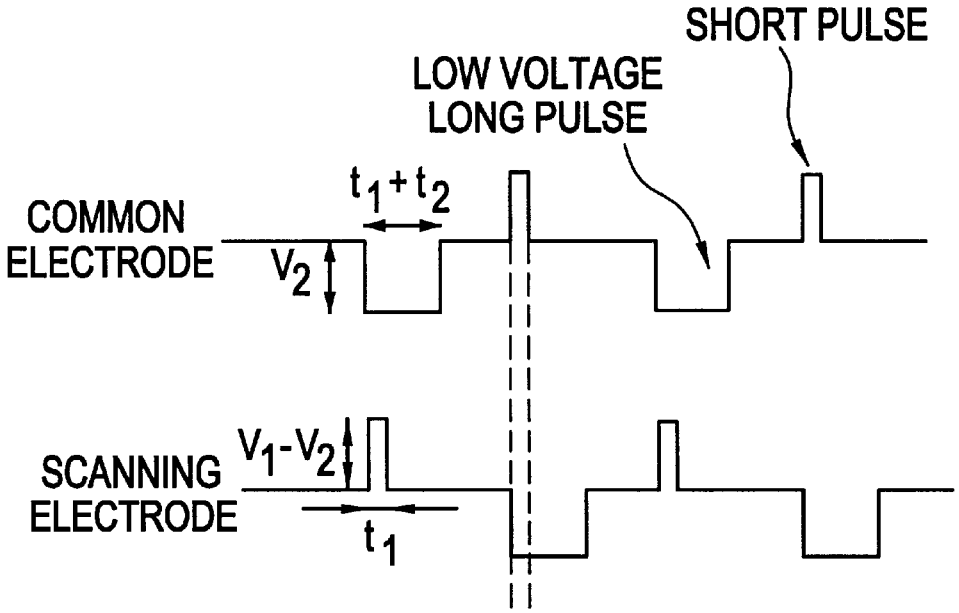
FIG. 9A is a diagram showing the waveforms of voltages applied to common electrodes and scanning electrodes in a method of energizing a PDP according to a third embodiment of the present invention.
Figure 9B:
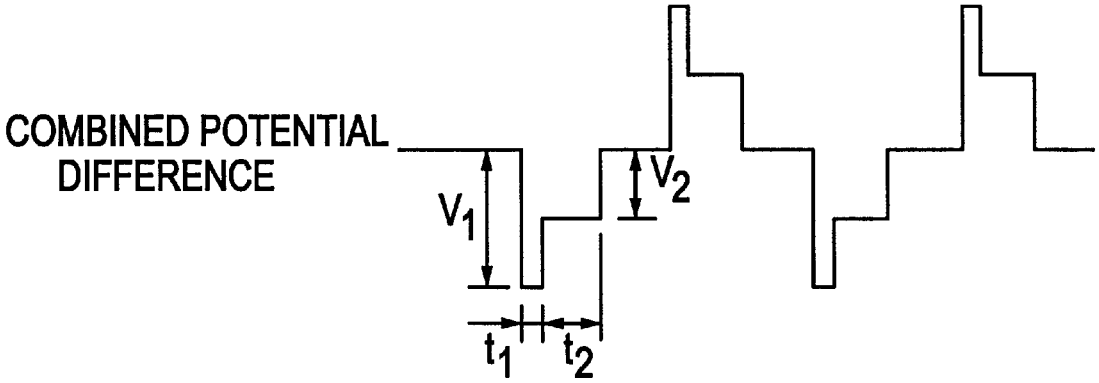
FIG. 9B is a diagram showing the waveform of a potential difference produced when the voltages shown in FIG. 9A are combined with each other.

A method of energizing a PDP according to a third embodiment of the present invention will be described below. FIG. 9A shows the waveforms of voltages applied to common electrodes and scanning electrodes in the method of according to the third embodiment. As shown in FIG. 9A, at the same time that a pulse of a low voltage and a long duration, which corresponds to a conventional sustaining discharge pulse, is applied to one of the electrodes, a pulse of a short duration, which is of opposite polarity to the low voltage pulse, is applied to the other electrode. When these pulses are applied to the electrodes, there is developed a potential difference between the electrodes as shown in FIG. 9B, which has the same waveform as the pulse applied to energize the PDP highly efficiently for high luminance in the method according to the first embodiment. According to the third embodiment, the voltage of the shorter pulse may be reduced by the voltage of the longer pulse, so that the pulses can be generated with ease.

Figure 10A:
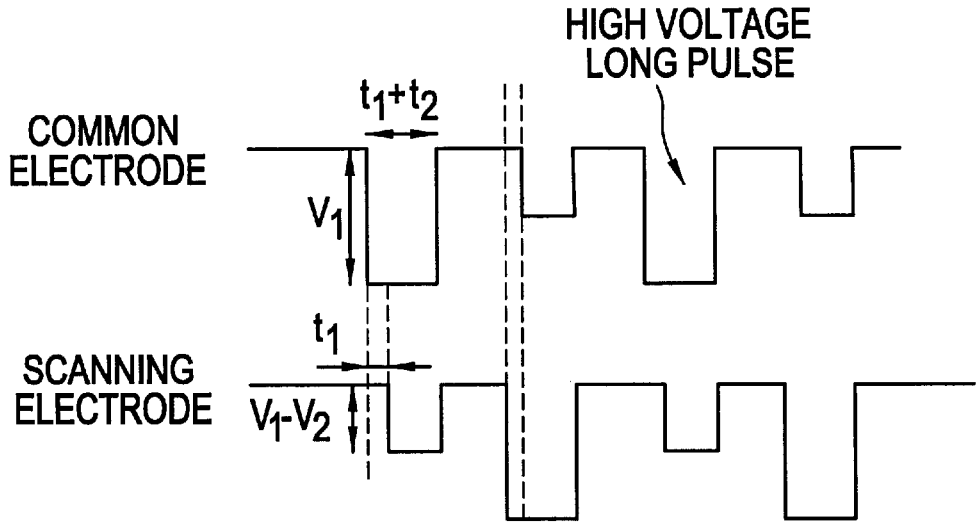
FIG. 10A is a diagram showing the waveforms of voltages applied to common electrodes and scanning electrodes in a method of energizing a PDP according to a fourth embodiment of the present invention.
Figure 10B:
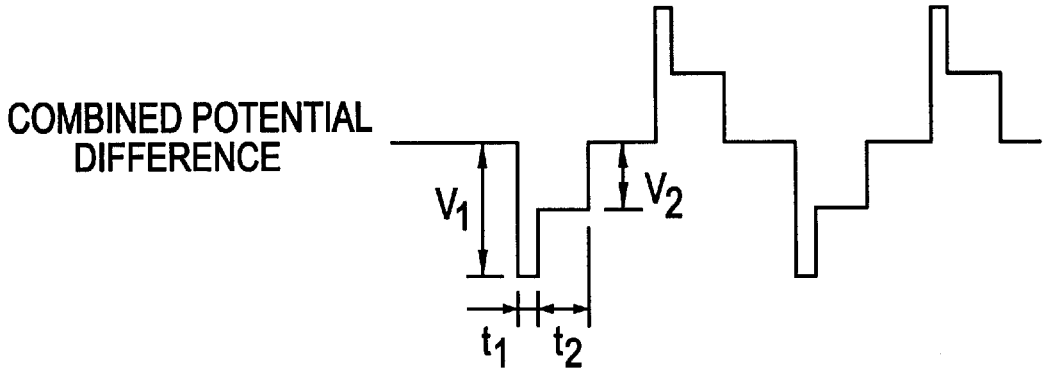
FIG. 10B is a diagram showing the waveform of a potential difference produced when the voltages shown in FIG. 10A are combined with each other.

A method of energizing a PDP according to a fourth embodiment of the present invention will be described below. FIG. 10A shows the waveforms of voltages applied to common electrodes and scanning electrodes in the method of according to the fourth embodiment. As shown in FIG. 10A, a pulse of a high voltage and a long duration is applied to one of the electrodes, and a pulse, which is of the same polarity as the high voltage pulse, is applied to the other electrode with a delay corresponding to a preset short pulse duration. When these pulses are applied to the electrodes, there is developed a potential difference between the electrodes as shown in FIG. 10B, which has the same waveform as the pulse applied to energize the PDP highly efficiently for high luminance in the method according to the first embodiment. According to the fourth embodiment, furthermore, since no independent short pulse is employed, pulses can be generated with ease.

Figure 11A:
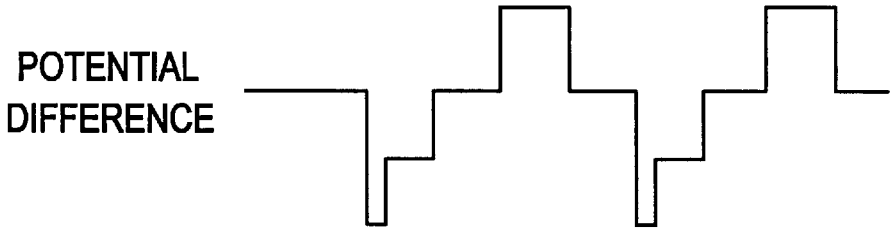
FIG. 11A is a diagram showing the waveform of a potential difference produced when voltages are combined with each other in a method of energizing a PDP according to a fifth embodiment of the present invention.

A method of energizing a PDP according to a fifth embodiment of the present invention will be described below. FIG. 11A shows the waveform of a potential difference produced when voltages are combined with each other in the method according to the fifth embodiment. As shown in FIG. 11A, a drive pulse according to the present invention and a conventional rectangular pulse are alternately applied to produce a sustaining discharge. Since the drive pulse according to the present invention increases efficiency and luminance, a portion of the conventional rectangular pulse may be replaced with the drive pulse according to the present invention for achieving the advantages of the present invention. According to the fifth embodiment, the principles of the present invention are applied to only sustaining pulses applied to common electrodes, for example, and sustaining pulses applied to scanning electrodes may be of conventional nature. Therefore, the method according to the fifth embodiment can easily be carried out.

Figure 11B:
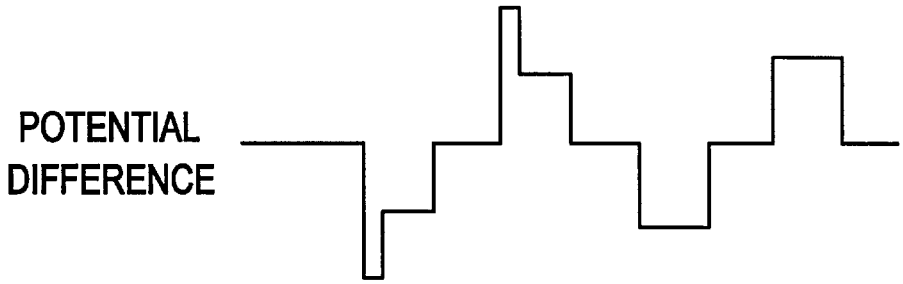
FIG. 11B is a diagram showing the waveform of another potential difference in the method according to the fifth embodiment of the present invention.

The conventional rectangular pulse may be replaced with the drive pulse according to the present invention during a sustaining pulse period, as shown in FIG. 11B. Therefore, the conventional rectangular pulse may be replaced in any of various patterns selected for the ease with which to carry out the method according to the fifth embodiment.

Figure 12:
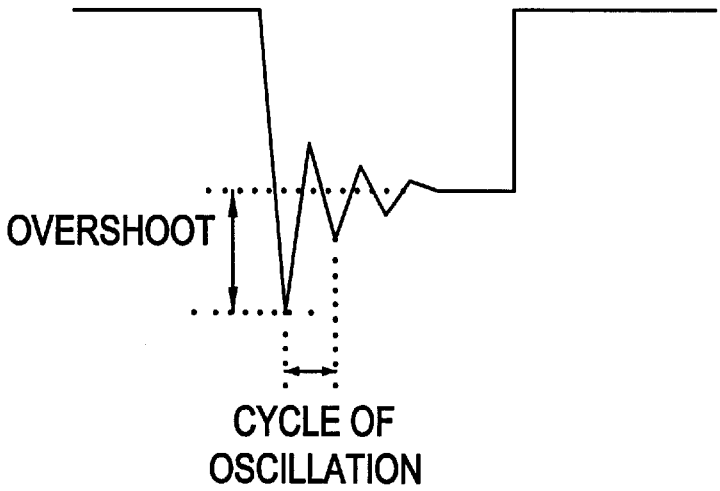
FIG. 12 is a diagram showing the waveform of a pulse employed in a method of energizing a PDP according to a sixth embodiment of the present invention.

A method of energizing a PDP according to a sixth embodiment of the present invention will be described below with reference to FIG. 12 which shows the waveform of a pulse employed in the method according to the sixth embodiment. As shown in FIG. 12, an overshoot at the negative-going edge of the pulse performs the same function as the high voltage pulse applied for the short time.

When a pulse is generated, because of resonance developed by a capacitive component and an inductive component, the pulse has an oscillating waveform, and suffers an overshoot in its initial transient period which exceeds the amplitude of the pulse. The period of the oscillation is determined by the values of a capacitance, an inductance, and a resistance. The capacitance, the inductance, and the resistance are installed outside of the PDP, and their values are adjusted to set a half period to about 200 nanoseconds. The first overshoot of the pulse is equivalent to the application of the voltage $V_1$ for the time $t_1$ in the method according to the first embodiment.

For example, if an inductance L and a capacitance C are connected in series with each other, then the period of oscillation is expressed by $2\pi\times(LC)^{1/2}$. When a capacitance of 100 picofarads and an inductance of 40 microhenries are connected, the period of oscillation is 397 nanoseconds, and the half period of oscillation is 200 nanoseconds. Since the actual PDP is not represented by a simple series-connected arrangement of LC, the values of the capacitance, the inductance, and the resistance which are installed outside of the PDP have to be adjusted in view of the pulse waveform. According to the sixth embodiment, any switching element for initially applying a high voltage for a short period in the pulse waveform for generating a sustaining discharge is not required, and hence the circuit arrangement of the PDP is relatively simple.

Figure 13A:
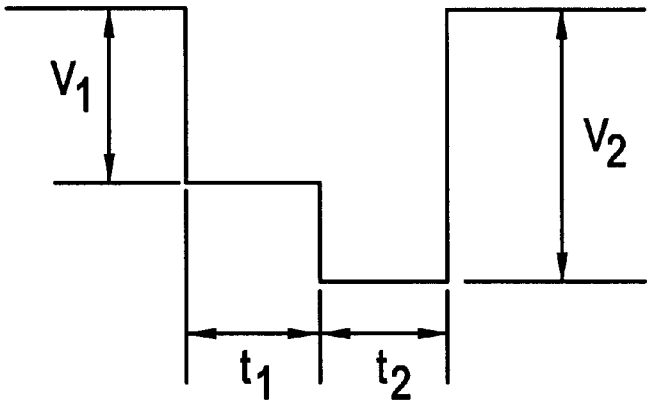
FIG. 13A is a diagram showing the waveform of a pulse employed in a method of energizing a PDP according to a seventh embodiment of the present invention.
Figure 13B:
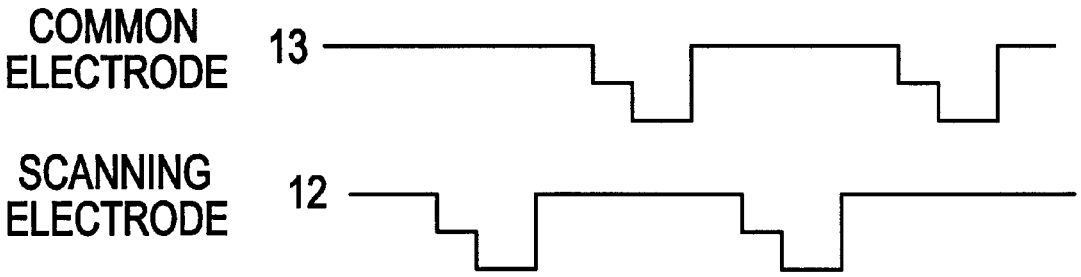
FIG. 13B is a diagram showing the waveforms of voltages applied to common electrodes and scanning electrodes during a sustaining pulse period according to the pulse waveform shown in FIG. 13A.
Figure 14A:
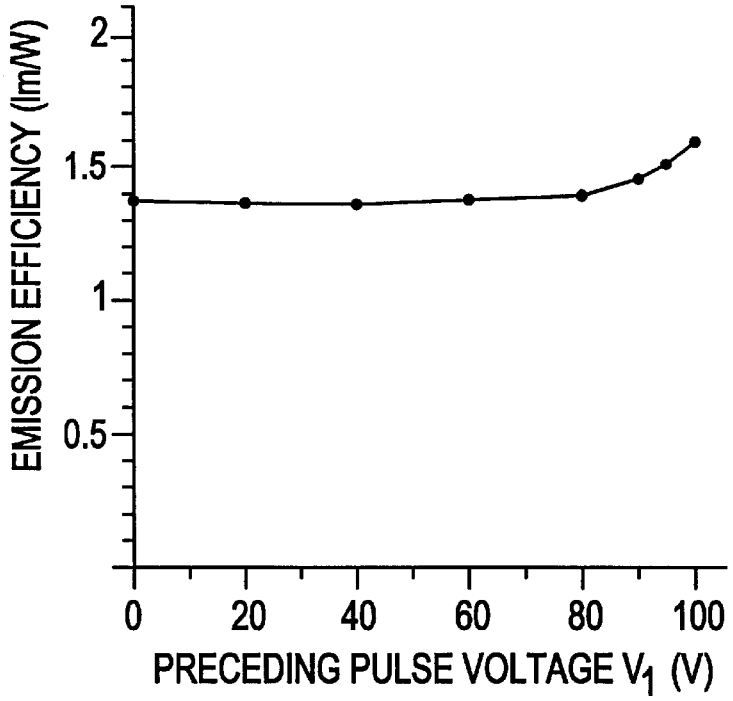
FIG. 14A is a diagram showing the relationship between the pulse voltage and the emission efficiency with the pulse waveform shown in FIG. 13A.
Figure 14B:
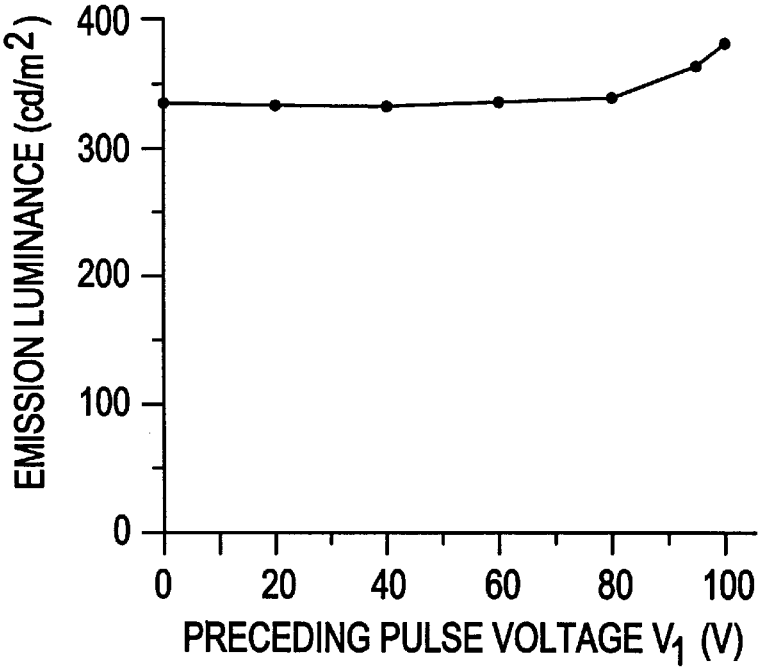
FIG. 14B is a diagram showing the relationship between the pulse voltage and the emission luminance with the pulse waveform shown in FIG. 13A.

FIG. 13A shows the waveform of a pulse employed in a method of energizing a PDP according to a seventh embodiment of the present invention, and FIG. 13B shows the waveforms of voltages applied to common electrodes and scanning electrodes during a sustaining pulse period according to the pulse waveform shown in FIG. 13A. FIG. 14A shows the relationship between the pulse voltage and the emission efficiency with the pulse waveform shown in FIG. 13A, and FIG. 14B shows the relationship between the pulse voltage and the emission luminance with the pulse waveform shown in FIG. 13A.

In the method according to the seventh embodiment, a voltage of a pulse waveform shown in FIG. 13A is applied to common and scanning electrodes 13, 12.

According to the pulse waveform shown in FIG. 13A, after a low voltage $V_1$ of a long duration $t_1$, e.g., $V_1$=100 V and $t_1$=3 microseconds, is applied, a high voltage $V_2$ of a long duration $t_2$, e.g., $V_2$=150 V and $t_2$=3 microseconds, is applied. With the pulse waveform according to the seventh embodiment, an actual discharge occurs when the subsequent high voltage $V_2$ is applied, and no discharge occurs when the preceding low voltage $V_1$ is applied. The pulse shown in FIG. 13A is applied as a sustaining discharge pulse to the common and scanning electrodes 13, 12 as shown in FIG. 13B.

A review of FIG. 5A which shows the relationship between the drive voltage and the emission efficiency when the PDP is driven with a conventional rectangular pulse at a frequency of 20 kHz, indicates that the emission efficiency is higher as the drive voltage is lower. However, a review of FIG. 5B which shows the relationship between the drive voltage and the emission luminance when the PDP is driven with a conventional rectangular pulse at a frequency of 20 kHz, indicates that the emission luminance is higher as the drive voltage is higher. Therefore, if the drive voltage is lowered to increase the emission efficiency, then the emission luminance is lowered, and if the drive voltage is increased to increase the emission luminance, then the emission efficiency is lowered.

FIG. 14A shows the relationship between the voltage $V_1$ of the preceding pulse and the emission efficiency when the PDP is driven with the pulse in the method according to the seventh embodiment. A study of FIG. 14A indicates that the emission efficiency increases when the preceding pulse voltage $V_1$ is 80V or higher. FIG. 14B shows the relationship between the voltage $V_1$ of the preceding pulse and the emission luminance when the PDP is driven with the pulse in the method according to the seventh embodiment. A study of FIG. 14B indicates that the emission luminance increases when the preceding pulse voltage $V_1$ is 80V or higher.

The graphs shown in FIGS. 14A and 14B show results measured under the conditions that no discharge was produced when the preceding pulse voltage $V_1$ was applied and a discharge was produced when the subsequent pulse voltage $V_2$ was applied. Under these conditions, both the emission efficiency and the emission luminance can be maximized when the preceding pulse voltage $V_1$ is maximized. With the examples shown in FIGS. 14A and 14B, it is most preferable that the preceding pulse voltage $V_1$ is 100 V.

The condition that no discharge is produced when the preceding pulse voltage $V_1$ is applied is required for the following reasons: As described above with respect to the conventional method, a sustaining discharge in an AC discharge PDP is caused by the superposition of a wall charge produced by an nth sustaining pulse and an (n+1)th sustaining pulse voltage. If a discharge occurs when the preceding low voltage $V_1$ is applied, then the potential difference between the electrodes due to the wall charge is inverted, and no discharge occurs even when the subsequent high voltage $V_2$ is applied. This discharge is the same as a discharge produced by a low drive voltage applied by a conventional rectangular pulse, and has low luminance though its efficiency is high. The function of the preceding low voltage $V_1$ is to develop a potential difference between the electrodes before a discharge occurs, for thereby controlling charged particles present in the discharge space. Therefore, no discharge should take place when preceding low voltage $V_1$ is applied. In the examples shown in FIGS. 14A and 14B, if the preceding low voltage $V_1$ is higher than 100 V, then a discharge occurs when the preceding low voltage $V_1$ is applied. Therefore, an upper limit for the preceding low voltage $V_1$ is set to 100 V.

For the same reasons, if the pulse duration $t_1$ of the preceding pulse is maximized insofar as no discharge occurs, then the effect of the preceding pulse on charged particles in the discharge space is increased for high luminance and high efficiency. The pulse duration $t_1$ is maximum for high luminance and high efficiency if the preceding pulse is applied immediately after the preceding discharge has ended, i.e., when the peak of the discharging current waveform due to the preceding discharge has sufficiently been attenuated.

The range of the preceding low voltage $V_1$ for providing the advantages of the seventh embodiment depends on the composition of the discharge gas and the structure of the PDP, and is not limited to 80 V<$V_1$<100 V.

Figure 15A:
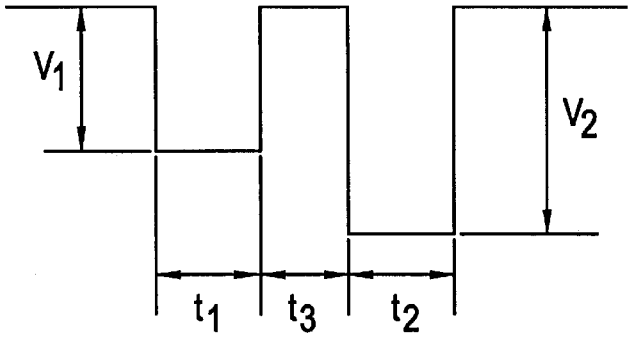
FIG. 15A is a diagram showing the waveform of pulses employed in a method of energizing a PDP according to an eighth embodiment of the present invention.
Figure 15B:
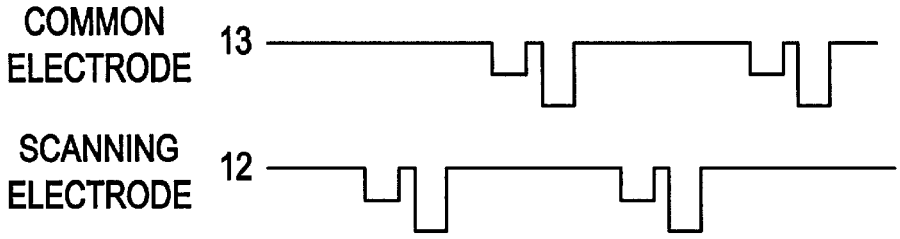
FIG. 15B is a diagram showing the waveforms of voltages applied to common electrodes and scanning electrodes during a sustaining pulse period according to the pulse waveform shown in FIG. 15A.

FIG. 15A shows the waveform of pulses employed in a method of energizing a PDP according to an eighth embodiment of the present invention, and FIG. 15B shows the waveforms of voltages applied to common electrodes and scanning electrodes during a sustaining pulse period according to the pulse waveform shown in FIG. 15A.

In the method according to the eighth embodiment, pulses shown in FIG. 15A are applied to common and scanning electrodes 13, 12. With the pulse waveform shown in FIG. 15A, a low voltage $V_1$ of a long duration $t_1$ is applied, then the voltage is held at a reference potential for a time $t_3$, after which a high voltage $V_2$ of a long duration $t_2$ is applied. These two pulses are combined to develop a single sustaining discharge. The pulse waveform shown in FIG. 15A is such that no discharge is produced when the preceding pulse voltage $V_1$ is applied and a discharge is produced only when the subsequent pulse voltage $V_2$ is applied.

The advantages of the preceding pulse voltage $V_1$ applied before a discharge starts to occur are exactly the same as those in the method according to the first embodiment. The voltage $V_1$ and the duration $t_1$ should be as large and long as possible for achieving the advantages insofar as no discharge occurs when the preceding pulse voltage $V_1$ is applied.

The time $t_3$ between the two pulses should be as long as possible for achieving the advantages. Because of limitations due to repeated sustaining discharges, however, the time $t_3$ is several microseconds or less. For example, if each of the repetitive frequencies of sustaining pulses applied to the common and scanning electrodes is 100 kHz, then the frequency of sustaining discharges is 200 kHz, and the period thereof is 5 microseconds. If each of the durations $t_1$, $t_2$ is about 2 microseconds, then the time $t_3$ should necessarily be 1 microsecond or shorter.

Figure 16A:
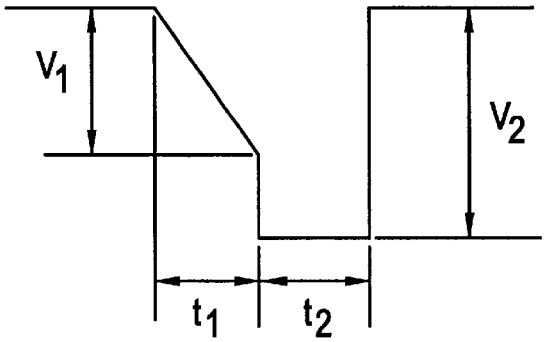
FIG. 16A is a diagram showing the waveform of a pulse employed in a method of energizing a PDP according to a ninth embodiment of the present invention.
Figure 16B:
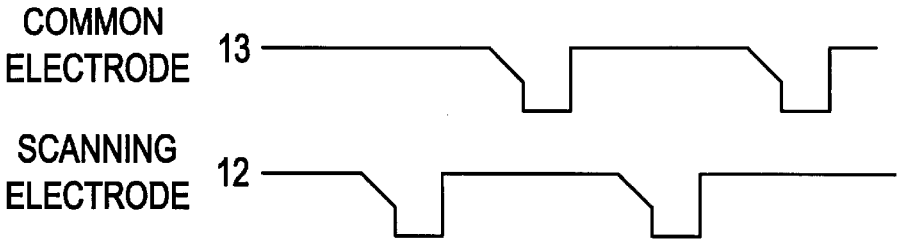
FIG. 16B is a diagram showing the waveforms of voltages applied to common electrodes and scanning electrodes during a sustaining pulse period according to the pulse waveform shown in FIG. 16A.

FIG. 16A shows the waveform of a pulse employed in a method of energizing a PDP according to a ninth embodiment of the present invention, and FIG. 16B shows the waveforms of voltages applied to common electrodes and scanning electrodes during a sustaining pulse period according to the pulse waveform shown in FIG. 16A.

In the method according to the ninth embodiment, a pulse shown in FIG. 16A is applied to common and scanning electrodes 13, 12, with the pulse waveform shown in FIG. 16A, an applied voltage is gradually lowered to a voltage $V_1$ for a time $t_1$, and then a high voltage $V_2$ of a long duration $t_2$ is applied. No discharge is produced until the application of the voltage $V_1$.

Figure 17A:
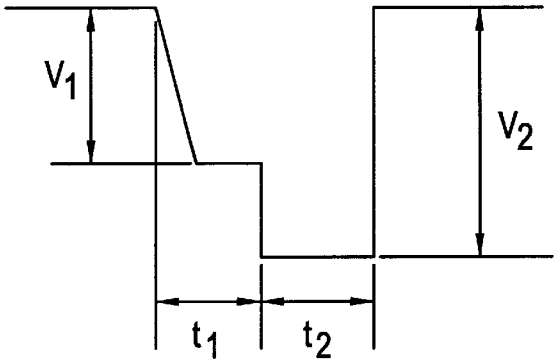
FIG. 17A is a diagram showing the waveform of another pulse employed in the method according to the ninth embodiment.
Figure 17B:
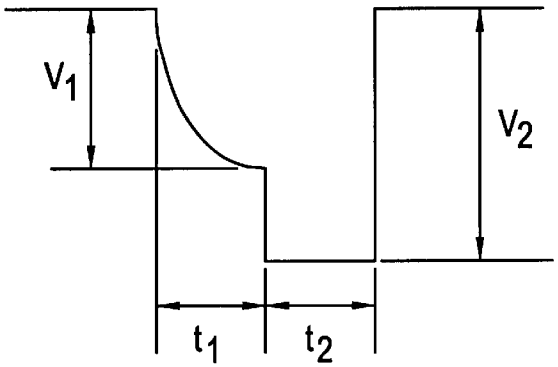
FIG. 17B is a diagram showing the waveform of still another pulse employed in the method according to the ninth embodiment.
Figure 17C:
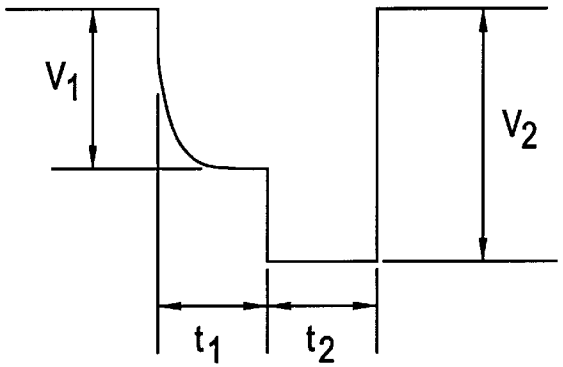
FIG. 17C is a diagram showing the:waveform of still yet another pulse employed in the method according to the ninth embodiment.

FIGS. 17A, 17B, and 17C show the waveforms of other pulses for applying a voltage which is gradually lowered to the voltage $V_1$. In FIG. 17A, the applied voltage is gradually lowered to and kept at the voltage $V_1$ for the time $t_1$. In each of FIGS. 17B and 17C, the waveform of the voltage which is gradually lowered is adjusted by a CR integrating circuit or the like. According to the ninth embodiment, it is necessary to apply a voltage which is as high as possible for a time which is as long as possible under the condition that no discharge occurs before the voltage $V_2$ is applied. Various drive circuits may be employed to apply pulses of waveforms other than those shown in FIGS. 17A, 17B, and 17C for achieving the same advantages.

Figure 18A:
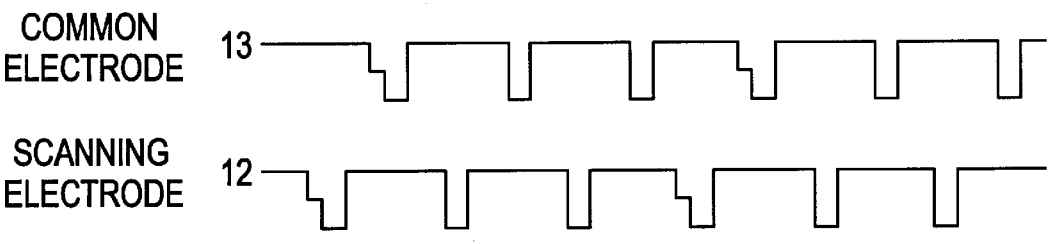
FIG. 18A is a diagram showing the waveforms of voltages applied to common electrodes and scanning electrodes during a sustaining pulse period in a method of energizing a PDP according to a tenth embodiment of the present invention.
Figure 18B:
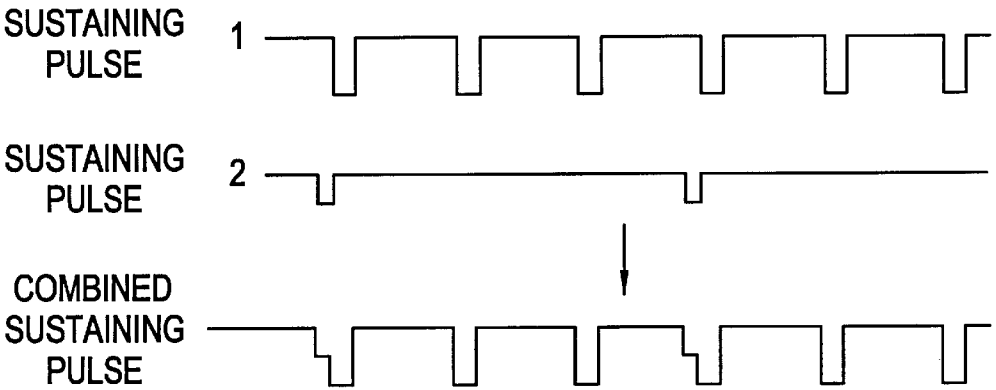
FIG. 18B is a diagram showing the manner in which the waveforms of applied voltages shown in FIG. 18A are generated by combining two pulse trains.

FIG. 18A shows the waveforms of voltages applied to common electrodes and scanning electrodes during a sustaining pulse period in a method of energizing a PDP according to a tenth embodiment of the present invention, and FIG. 18B shows the manner in which the waveforms of applied voltages shown in FIG. 18A are generated by combining two pulse trains.

In the method according to the tenth embodiment, pulses shown in FIG. 18A are applied to common and scanning electrodes 13, 12. Sustaining pulses shown in FIG. 18B include pulses, each in three cycles, which are of the pulse waveform shown in FIG. 13A. According to the tenth embodiment, the advantages of high efficiency and high luminance are reduced to one-third of those which are obtained if all the sustaining pulses are of the pulse waveform shown in FIG. 13A. If two sustaining pulse trains 1, 2 shown in FIG. 18B are combined to generate the sustaining pulses, then since the frequency of the sustaining pulse train 2 may be relatively low, the method according to the tenth embodiment can easily be carried out. While each in three cycles of the sustaining pulses applied to the common and scanning electrodes 13, 12 is of the pulse waveform shown in FIG. 13A in the tenth embodiment, the pulse waveform shown in FIG. 13A may be applied to each in other cycles of sustaining pulses, or each in different cycles of sustaining pulses applied to the common and scanning electrodes 13, 12.

Figure 19:
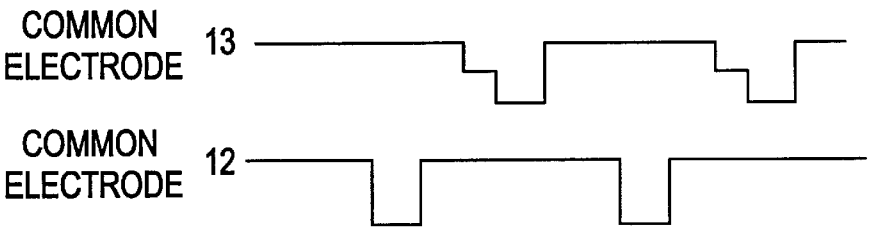
FIG. 19 is a diagram showing the waveforms of voltages applied to common electrodes and scanning electrodes in a method of energizing a PDP according to an eleventh embodiment of the present invention.

FIG. 19 shows the waveforms of voltages applied to common electrodes and scanning electrodes in a method of energizing a PDP according to an eleventh embodiment of the present invention.

In the method according to the eleventh embodiment, only sustaining pulses applied to the common electrodes 13 are of the pulse waveform shown in FIG. 13A, as shown in FIG. 19.

In the above embodiments, sustaining discharges are produced by negative pulses. However, sustaining discharges may be produced by positive pulses, and a positive high voltage may be applied in a short time in the initial period of each of the positive sustaining pulses.

The numerical values given in the above embodiments for voltages and pulse durations were produced as a result of experiments, and may be adjusted if a discharge gas of a different composition and a different PDP cell structure are employed.

With sustaining pulse waveform according to the present invention, since the emission luminance and the emission efficiency of individual sustaining pulses are increased, if the principles of the present invention are applied to sustaining pulses applied to one of the common and scanning electrodes, then half of all the sustaining discharges are of high luminance and high efficiency. The advantages of the present invention are maximized if the principles of the present invention are applied to all sustaining pulses applied to the common and scanning electrodes. In this case, however, drivers for both the common and scanning electrodes need to be modified. If the principles of the present invention are applied to sustaining pulses applied to one of the common and scanning electrodes, then any drive modification may be reduced to half, and the methods according to the present invention can be carried out with ease.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A method of energizing a plasma display panel having a plurality of scanning electrodes arranged as rows and a plurality of data electrodes arranged as columns, comprising the steps of:

applying a scanning pulse voltage to the scanning electrodes;

applying a data pulse voltage to the data electrodes in synchronism with said scanning pulse voltage for controlling turning-on/off of displayed data; and thereafter, applying a sustaining pulse voltage of a waveform having repetitive units, each of said units comprising a preceding high potential difference of a short duration and a subsequent low potential difference of a long duration, alternately to two electrodes selected from the scanning electrodes, the data electrodes, and common electrodes arranged as rows independently of the scanning electrodes, for thereby keeping a sustaining discharge only in cell where the displayed data is turned on, wherein said low potential difference is not zero.

2. A method according to claim 1, wherein said short duration of the preceding high potential difference is shorter than a delay time from the application of the sustaining pulse voltage until a gas discharging current is maximized.

3. A method according to claim 1, wherein said long duration of said subsequent low potential difference and a setting of said subsequent low potential difference are determined to keep said sustaining discharge even in the absence of the duration of the preceding high potential difference.

4. A method according to claim 1, wherein each of said repetitive units includes a high voltage pulse of a short duration applied to one of the two electrodes and a low voltage pulse, in opposite polarity to said high voltage pulse, of a long duration applied to the other of the two electrodes after said high voltage pulse has ended.

5. A method according to claim 1, wherein each of said repetitive units includes a pulse of a short duration applied to one of the two electrodes and a low voltage pulse, in opposite polarity to said pulse, of a long duration applied to the other of the two electrodes at the same time that said pulse is applied to said one of the two electrodes.

6. A method according to claim 1, wherein each of said repetitive units includes a high voltage pulse of a long duration applied to one of the two electrodes and a low voltage pulse, in the same polarity as said high voltage pulse, of a long duration applied to the other of the two electrodes with a delay equal to said short duration of the high voltage pulse after the application of said high voltage pulse.

7. A method according to claim 1, wherein a portion of a plurality of sustaining pulses for producing a sustaining discharge has said waveform of the sustaining pulse voltage.

8. A method according to claim 1, wherein a plurality of sustaining pulses applied to one of the two electrodes for producing a sustaining discharge have said waveform of the sustaining pulse voltage.

9. A method according to claim 1, wherein said preceding high potential difference is generated by an overshoot in excess of the amplitude of the sustaining pulse voltage.

10. A method of energizing a plasma display panel having a plurality of scanning electrodes arranged as rows and a plurality of data electrodes arranged as columns, comprising the steps of:

applying a scanning pulse voltage to the scanning electrodes;

applying a data pulse voltage to the data electrodes in synchronism with said scanning pulse voltage for controlling turning-on/off of displayed data; and thereafter, applying a sustaining pulse voltage of a waveform having repetitive units, each of said units comprising a preceding low voltage and a subsequent high voltage of a long duration for producing a sustaining discharge, alternatively to two electrodes selected from the scanning electrodes, the data electrodes, and common electrodes arranged as rows independently of the scanning electrodes, for thereby keeping a sustaining discharge only in cells where the displayed data is turned on, wherein said preceding low voltage is not zero.

11. A method according to claim 10, wherein said preceding low voltage is of a level and a duration which are selected to fail to produce a sustaining discharge.

12. A method according to claim 10, wherein said preceding low voltage and said subsequent high voltage are successively applied.

13. A method according to claim 10, wherein each of said repetitive units includes a reference potential or a potential lower than said preceding low voltage, between said preceding low voltage and said subsequent high voltage.

14. A method according to claim 10, wherein a portion of a plurality of sustaining pulses for producing a sustaining discharge has said sustaining pulse voltage.

15. A method according to claim 10, wherein said sustaining pulse voltage is applied to one of the two electrodes for generating a sustaining discharge.

* * * * *